US008898851B2

(12) United States Patent
Leeman et al.

(10) Patent No.: US 8,898,851 B2
(45) Date of Patent: Dec. 2, 2014

(54) DOCTOR BLADE HOLDER

(75) Inventors: David Leeman, Worcester, MA (US); Allen Brauns, Sturbridge, MA (US); Robert Johnson, Sutton, MA (US)

(73) Assignee: Kadant, Inc., Westford, MA (US)

( * ) Notice: Subject to any disclaimer, the term of this patent is extended or adjusted under 35 U.S.C. 154(b) by 147 days.

(21) Appl. No.: 13/315,899

(22) Filed: Dec. 9, 2011

(65) Prior Publication Data

US 2012/0167330 A1 Jul. 5, 2012

Related U.S. Application Data

(60) Provisional application No. 61/421,751, filed on Dec. 10, 2010.

(51) Int. Cl.
*D21G 3/00* (2006.01)

(52) U.S. Cl.
CPC ..... *D21G 3/005* (2013.01); *B41P 2235/21* (2013.01)
USPC ..... 15/256.51; 15/256.5

(58) Field of Classification Search
USPC ..... 15/256.5, 256.51–256.53, 300.1
See application file for complete search history.

(56) References Cited

U.S. PATENT DOCUMENTS

| | | | |
|---|---|---|---|
| 2,352,220 A | 6/1944 | Overton | |
| 3,010,134 A | 11/1961 | Goyette | |
| 3,149,005 A | 9/1964 | Brundige | |
| 3,264,673 A | 8/1966 | Scott | |
| 3,624,860 A | 12/1971 | Grimston et al. | |
| 3,803,665 A | 4/1974 | Winterburn et al. | |
| 4,185,399 A | 1/1980 | Gladish | |
| 4,700,493 A | 10/1987 | Wedel et al. | |
| 4,953,252 A | 9/1990 | Akisawa | |
| 5,021,124 A | 6/1991 | Turtinen et al. | |
| 5,597,449 A | 1/1997 | Vestola et al. | |
| 5,657,693 A | 8/1997 | Kumaki et al. | |
| 5,791,067 A | 8/1998 | Bendtsen | |
| 6,139,638 A | 10/2000 | Dubois et al. | |
| 6,386,106 B1 | 5/2002 | Stanka | |
| 6,434,785 B1 * | 8/2002 | Vandenbelt et al. | 15/344 |
| 6,447,646 B1 | 9/2002 | Hassinen et al. | |
| 6,491,791 B1 | 12/2002 | Loippo | |
| 6,687,950 B1 | 2/2004 | Rata et al. | |

(Continued)

FOREIGN PATENT DOCUMENTS

| | | |
|---|---|---|
| DE | 4108167 | 9/1992 |
| DE | 4108167 A1 | 9/1992 |

(Continued)

OTHER PUBLICATIONS

International Search Report and Written Opinion issued on Jun. 22, 2012 in connection with International Appln. PCT/US2011/064187, 13 pages.

(Continued)

*Primary Examiner* — Shay Karls
(74) *Attorney, Agent, or Firm* — Gesmer Updegrove LLP

(57) ABSTRACT

A doctor blade holder system is disclosed that includes a doctor blade holder that includes a doctor blade receiving region for receiving a doctor blade, and an actuation system for causing the doctor blade receiving region to be selectively moved toward or away from a roll surface by rotating the doctor blade holder about a first axis, wherein the doctor blade holder system is generally circular shaped in cross-sectional area and wherein the first axis is generally centrally locate with the generally circular cross-sectional area.

22 Claims, 16 Drawing Sheets

(56) References Cited

U.S. PATENT DOCUMENTS

| | | | | |
|---|---|---|---|---|
| 6,942,734 | B2 | 9/2005 | Rata et al. | |
| 8,321,992 | B2 * | 12/2012 | Gauvin et al. | 15/256.51 |
| 2005/0098292 | A1 | 5/2005 | Ried et al. | |
| 2006/0054293 | A1 | 3/2006 | Strauch | |
| 2006/0180291 | A1 | 8/2006 | Rata | |
| 2006/0289141 | A1 | 12/2006 | Rata et al. | |

FOREIGN PATENT DOCUMENTS

| | | | |
|---|---|---|---|
| DE | 10051999 | A1 | 5/2002 |
| WO | 9937856 | | 7/1999 |
| WO | 9937856 | A1 | 7/1999 |
| WO | 2009108754 | | 9/2009 |
| WO | 2009108754 | A1 | 9/2009 |

OTHER PUBLICATIONS

International Preliminary Report on Patentability issued on Jun. 20, 2013 in connection with International Application PCT/US2011/064187, 9 pages.

English Translation of German Patent No. 100 51 999 for "Method for changing a scraper blade and scraper blade arrangement", 21 pages, Oct. 20, 2005.

* cited by examiner

DOCTOR BLADE HOLDER

PRIORITY INFORMATION

The present application claims the benefit of U.S. Provisional Patent Application Ser. No. 61/421,751 which was filed on Dec. 10, 2010, all of which is incorporated herein in its entirety.

BACKGROUND OF THE INVENTION

1. Field of the Invention

This invention relates to doctors for processing moving surfaces in manufacturing systems involving rolls, webs or sheets such as papermaking systems, fiber and textile processing systems and aluminum/steel processing, and is concerned in particular with an improved design that simplifies construction for certain applications yet meets the high demands of doctoring systems.

2. Description of the Prior Art

Many roll cleaning and sheet shedding applications on web handling applications such as paper and textile processing machines involve blade support devices commonly referred to as doctor blade holders for supporting blades such as doctor blades, creping blades and scraping blades.

Certain prior art doctor blade holders include a top plate (to which a doctor blade is joined), a bottom plate, and a mounting and adjustment assembly between the top and bottom plates. The bottom plate is mounted on a doctorback, which is a heavy-duty beam that spans the paper machine width. The rear portion of a doctor blade is received into the doctor blade holder that supports the blade in a pre-determined position relative to a surface to be cleaned. The doctor blade holder works in concert with the doctor blade to apply the working edge of the doctor blade, found on the blade's front portion, to an adjacent moving surface such as a roll.

FIG. 1 for example, shows a prior art doctoring apparatus 10 that is adjacent to the surface of a roll 12. The roll rotates about an axis $A_r$, and the doctoring apparatus includes a doctorback 14 that is rotatable about an axis $A_{db}$, which is parallel to the axis $A_r$. A doctor blade holder 16 is shown supported on a beam 18, which forms part of the doctorback. The doctor blade holder 16 includes has top plate 20 and a bottom plate 22 that are joined by a mounting and adjustment assembly. A doctor blade 24 is received within a lower jaw opening 26 on the underside of the top plate 20.

With further reference to FIG. 2, the mounting and adjustment assembly includes a plurality of top plate brackets 28 and a plurality of bottom plate brackets 30 that are mutually joined together by a pivot rod 32. The mounting and adjustment assembly also includes a loading tube 34 and an unloading tube 36 that may each be alternately increased or decreased in size by adjusting an amount of fluid within each tube to effect a limited rotation of the top plate with respect to the axis that is the central axis of the pivot rod 32. This limited rotation permits the doctor blade 24 to engage the roll 12 to effect doctoring, or to disengage the roll 12. A piston/cylinder unit 38 acts via a crank arm 39 to rotate the doctorback 14 about axis $A_{db}$ in order to provide gross positioning of the doctor blade 24 near and away from the roll surface.

Doctor blade holders are typically assemblages of several discrete components, many of which (such as the brackets 28 and 30) are duplicated within the assembly dozens or scores of times, and must be riveted or otherwise fastened to the plates 20 and 22 respectively. This multiplicity of components has allowed holder manufacturers to custom-build holders to match the custom-built paper machines. These multiple repeating components, however, require substantial assembly time, which increases holder cost and opportunities for assembly errors.

Other prior art doctor blade holders, such as disclosed in U.S. Pat. No. 6,447,646, include an extruded or pultruded holder frame 40 that is pivotally mounted to an extruded or pultruded bearer 42 via a jointed bearing assembly 44 as shown in FIG. 3. The jointed bearing assembly 44 includes a joint sleeve 46 (e.g., in holder frame 40) that couples with a unified axle 48 (e.g., in the bearer 42). A doctor blade 50 is coupled to a blade holder 52, which is attached to the holder frame 40. Loading devices 54 and 56 apply positive and negative loading forces to the doctor blade 50 with respect to the roll 58. Separating the holder frame 40 from the bearer 42, however, requires sliding the holder frame 40 and the bearer 42 with respect to one another along the full elongated dimension of the doctoring apparatus, which may be a several or more meters in width. This may not only be awkward and/or impractical, but it may further require that the doctoring apparatus be moved to a more spacious location. U.S. Patent Applications Publication Nos. 2006/0180291 and 2006/0289141, as well as U.S. Pat. No. 6,942,734 also disclose doctor blade holder systems that include integrally formed mounting elements that extend along the elongated dimension of the doctor blade.

Further prior art blade holder systems, such as for example disclosed in U.S. Patent Application Publication No. 2006/0054293, include a base plate 60 and a cover plate 62 having a finger device 64 that receives a scrapping blade 66 as shown in FIG. 4. The base plate 60 and cover plate 62 are pivotally coupled together by a bearing tube 68 mounted on the based plate 60, which is received within a square tube 70 mounted to the underside of the cover plate 62. The square tube 70 is disclosed to be installed in segments in a direction perpendicular to the plane of the drawing in order to impair the resilience of the cover plate 62 as little as possible. The rotational position of the cover plate 62 with respect to the base plate 60 is adjustable by the inflation/deflation of an air pressure hose 72 in cooperation with a spring 74. Separating the cover plate 62 from the base plate 60, however, requires sliding the cover plate 62 and the base plate 60 with respect to one another along the full elongated dimension of the doctoring apparatus, which may be a several or more meters in width.

An objective of the present invention is to provide an improved holder design that greatly reduces the number of components and therefore the cost, yet satisfies the demanding strength requirements of doctor blade holder systems.

SUMMARY OF THE INVENTION

In accordance with an embodiment, the invention provides a doctor blade holder system that includes a doctor blade holder that includes a doctor blade receiving region for receiving a doctor blade, and an actuation system for causing the doctor blade receiving region to be selectively moved toward or away from a roll surface by rotating the doctor blade holder about a first axis, wherein the doctor blade holder system is generally circular shaped in cross-sectional area and wherein the first axis is generally centrally locate with the generally circular cross-sectional area.

In accordance with another embodiment, the invention provides a doctor blade holder system including a doctor blade holder that includes a doctor blade receiving region for receiving a doctor blade, and an actuation system for causing the doctor blade receiving region to be selectively moved toward or away from a roll surface by rotating the doctor blade holder about a first axis, wherein the first axis passes through a generally central region of the doctor blade holder.

In accordance with a further embodiment, the invention provides a doctor blade holder system including a doctor blade holder that includes a doctor blade receiving region for receiving a doctor blade, a fixed structure that pivotally receives a portion of the doctor blade holder at either longitudinal end of the doctor blade holder, and an actuation system for causing the doctor blade receiving region to be selectively moved toward or away from a roll surface by rotating the doctor blade holder about a first axis, wherein the first axis passes through both the doctor blade holder and the fixed structure.

A primary object of the present invention is to provide a simplified doctoring structure designed to fit into the narrow confines of compact web and web-like processing machines while still providing control of doctor blade loading as well as efficient and safe access to the doctor blade for removal and replacement.

Another object is to integrate the one or more renewable debris collection systems into the holder body.

Another object is to integrate within the same holder body uniform vacuum pressure means and directing said vacuum to the area near the blade-roll contact line in order to remove debris that is known to accumulate there.

Another object is to provide within the doctor body, means for attaching journals and other external loading mechanisms without resort to welding or other machine work.

Another object is to provide within the doctor design a two-tube blade loading and unloading system familiar to web processing machine operators and easily integrated with pre-existing equipment.

Another object is to provide significant doctor weight reduction by forming at least one of the two pieces with a substantially hollow cross-section.

Another object is to incorporate groups of one or more holder components into formed pieces via extrusion processes thereby reducing assembly part counts and associated labor, as compared to the multiple part assembly processes of prior art holders.

Another object is to provide a doctor blade retention feature formed directly into the single-component doctor structure.

Another object is to provide a blade retention means that efficiently conveys the load imposed on the doctor blade by the doctored surface to the doctor's external supports.

Another object is to provide a debris accumulation region formed into the doctor structure.

BRIEF DESCRIPTION OF THE DRAWINGS

The following description may be further understood with reference to the accompanying drawings in which.

The drawings are show for illustrative purposes only.

DETAILED DESCRIPTION

The present invention incorporates the functions of the doctor blade holder and the doctorback into a single doctoring element, substantially reducing complexity, manufacturing cost, and weight.

Figure 1:
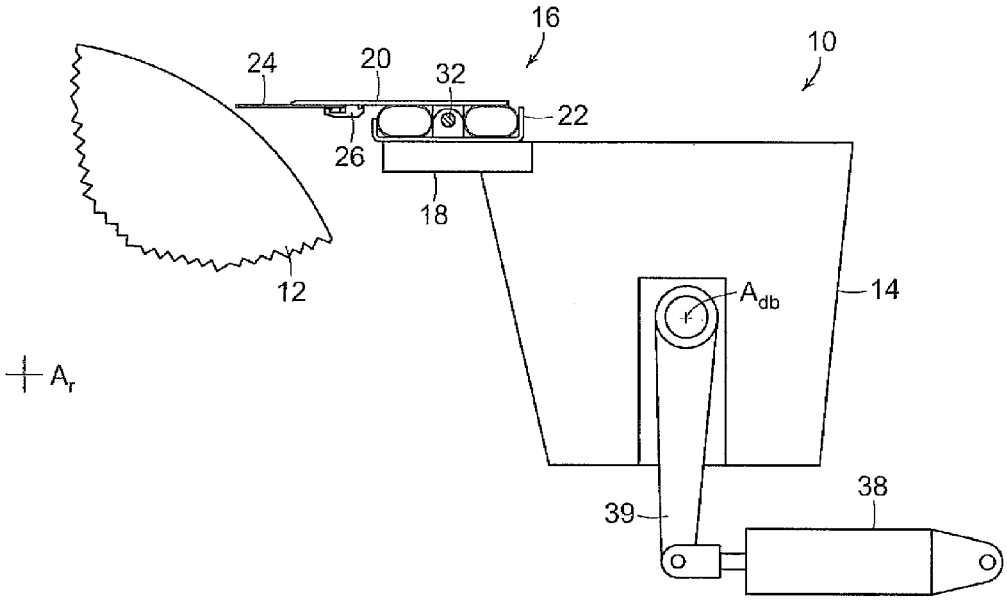
FIG. 1 PRIOR ART
FIG. 1 shows an illustrative diagrammatic side view of a prior art doctor blade holder attached to a doctorback.
Figure 2:
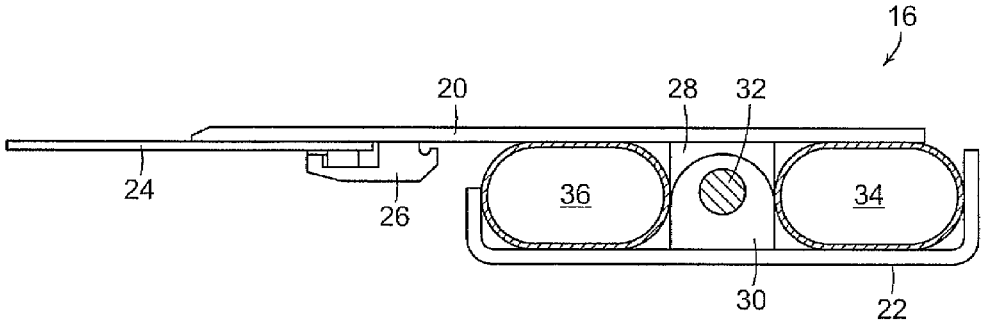
FIG. 2 PRIOR ART
FIG. 2 shows an illustrative diagrammatic enlarged side view of the doctor blade holder of FIG. 1.
Figure 3:
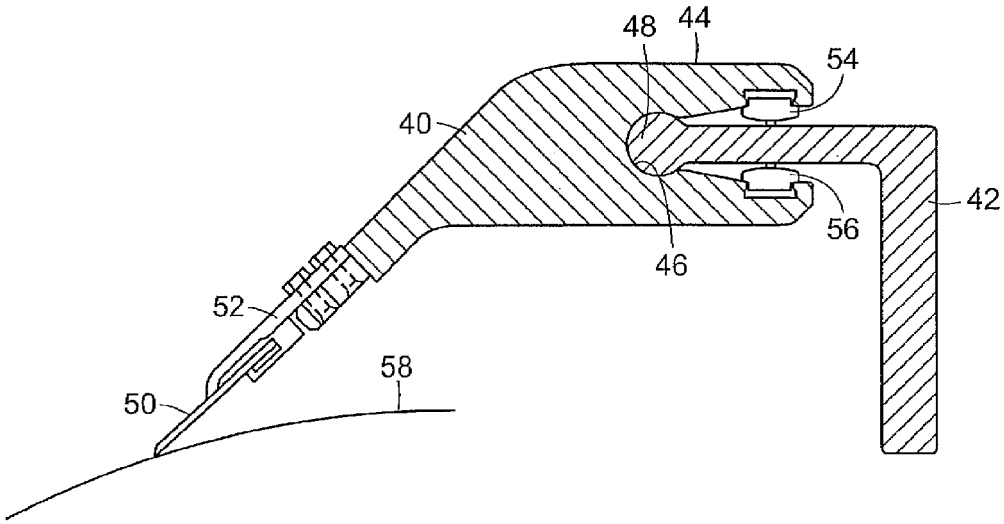
FIG. 3 PRIOR ART
FIGS. 3 and 4 show illustrative diagrammatic side views of further prior art doctor blade holders.
Figure 4:
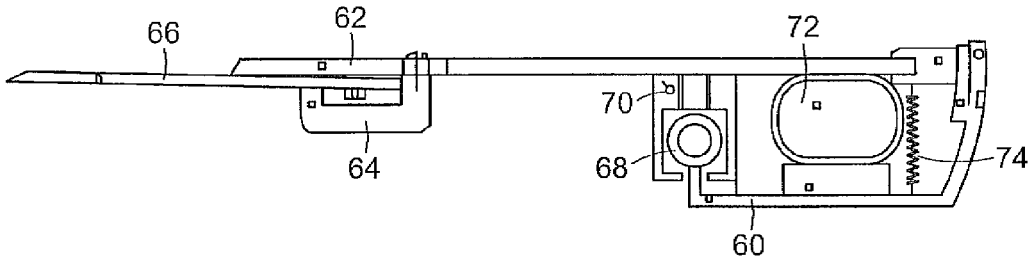
FIG. 4 PRIOR ART
Figure 5:
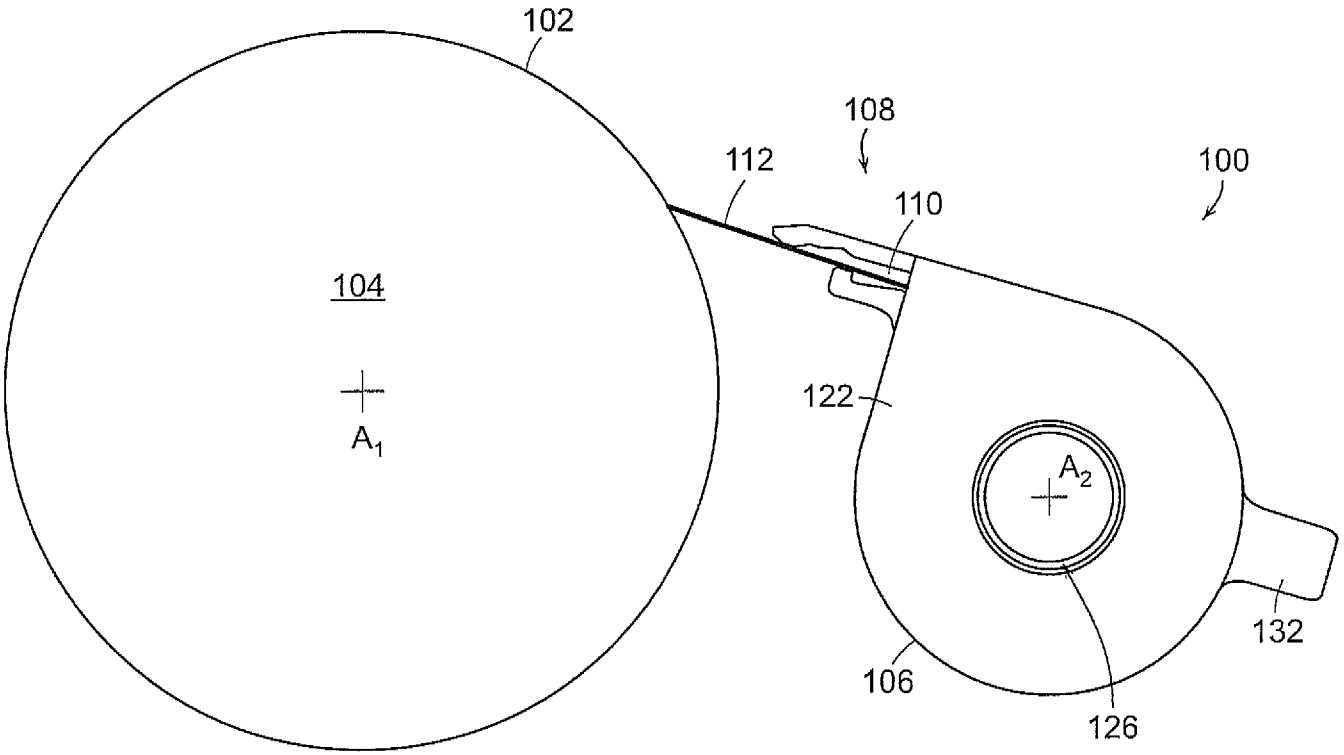
FIG. 5 shows an illustrative diagrammatic side view of a doctor blade holder in accordance with an embodiment of the present invention.

With reference initially to FIG. 5, a doctor blade holder system 100 is shown adjacent to the surface 102 of a roll 104. The roll 104 rotates about an axis $A_1$, and the doctoring apparatus includes a doctor blade holder 106 that is rotatable about an axis $A_2$, which is parallel to axis $A_1$. The doctor blade retention region 108 in accordance with the present embodiment is included as an integral part of the doctor blade holder 106 as further shown in FIGS. 6 and 7. The blade retention region 108 defines a slot 110 for receiving the rear edge of a doctor blade 112. The forward edge of the doctor blade is applied to the surface 102 of the roll 104 to effect doctoring.

The doctor blade holder 106 includes a doctor blade holder core 114 that is formed, preferably by extrusion, from metal, such as stainless steel alloys such as 300 series, or aluminum alloys such as series 6000, the latter being preferred. Such aluminum alloys may be treated with one or more protective coatings as is well known to those skilled in the art.

Figure 6:
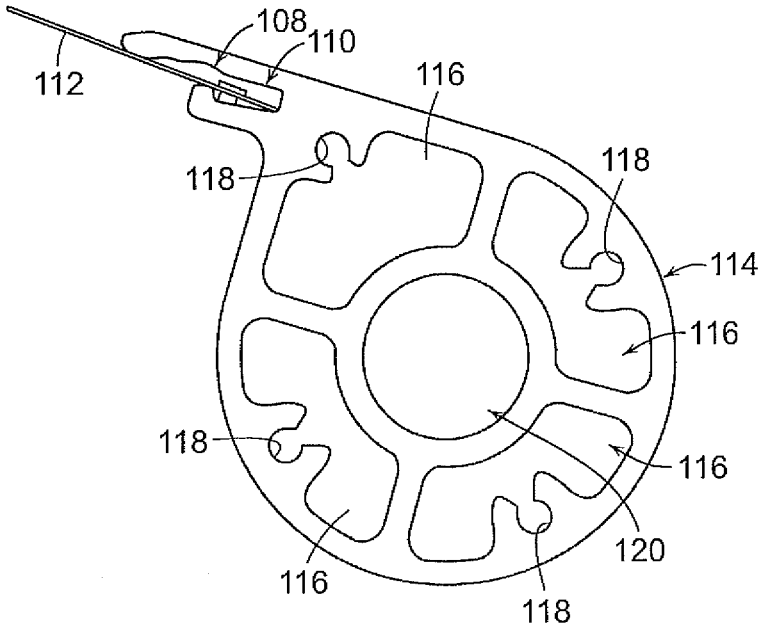
FIG. 6 is an illustrative diagrammatic partial cross-sectional view of the doctor blade holder of FIG. 5 showing the integrated blade retention, journal mounting and component fastening features.
Figure 8:
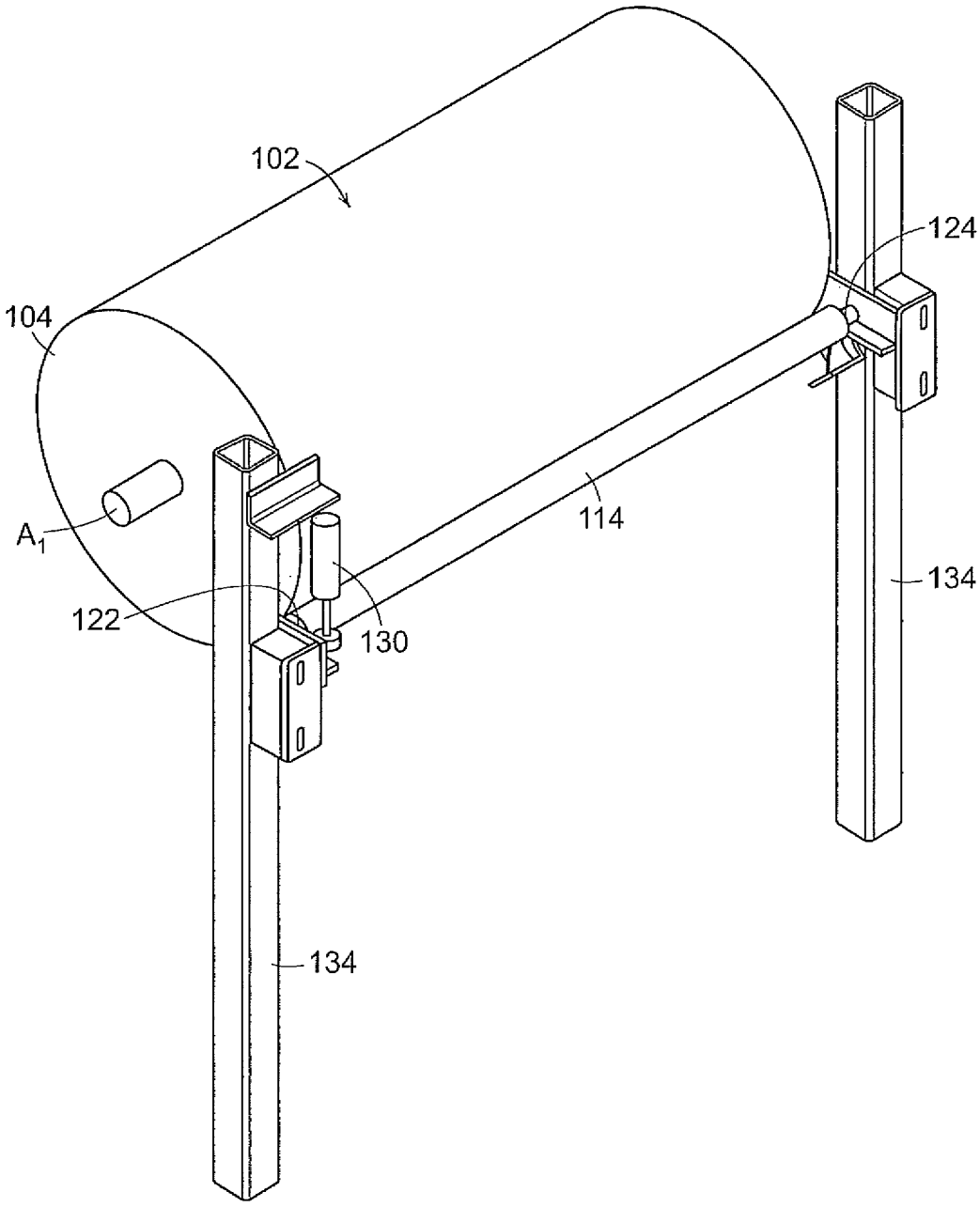
FIG. 8 shows an illustrative diagrammatic view of doctoring system using the doctor blade holder of FIGS. 5-7 using air cylinders to rotate the doctor blade holder toward or away from a roll.

With reference to FIG. 6, the doctor blade holder 106 is shown in partial cross-section to illustrate that the doctor blade holder core 114 is hollow and includes internal features such as cross-machine chambers 116, component fastening structures 118 and a journal bore 120. Also shown are the doctor blade 112 and the doctor blade retention region 108. The component fastening features 118 provide that the doctor blade holder core 114 may be attached to cover plates 122 and 124 at either end of the doctor blade holder core 114 as shown in FIG. 8. Mating portions of the cover plates 122 and 124 engage the component fastening features 118 of the doctor blade holder core 114. The cross machine chambers 116 and journal bore 120 reduce the weight (and therefore inertia) of the doctor blade holder without compromising its rigidity and strength. In further embodiments, as discussed below, the cross machine chambers 116 and journal bore 120 may further be used to provide fluid (such as vacuum) to an area proximate the doctor blade 112.

Figure 7:
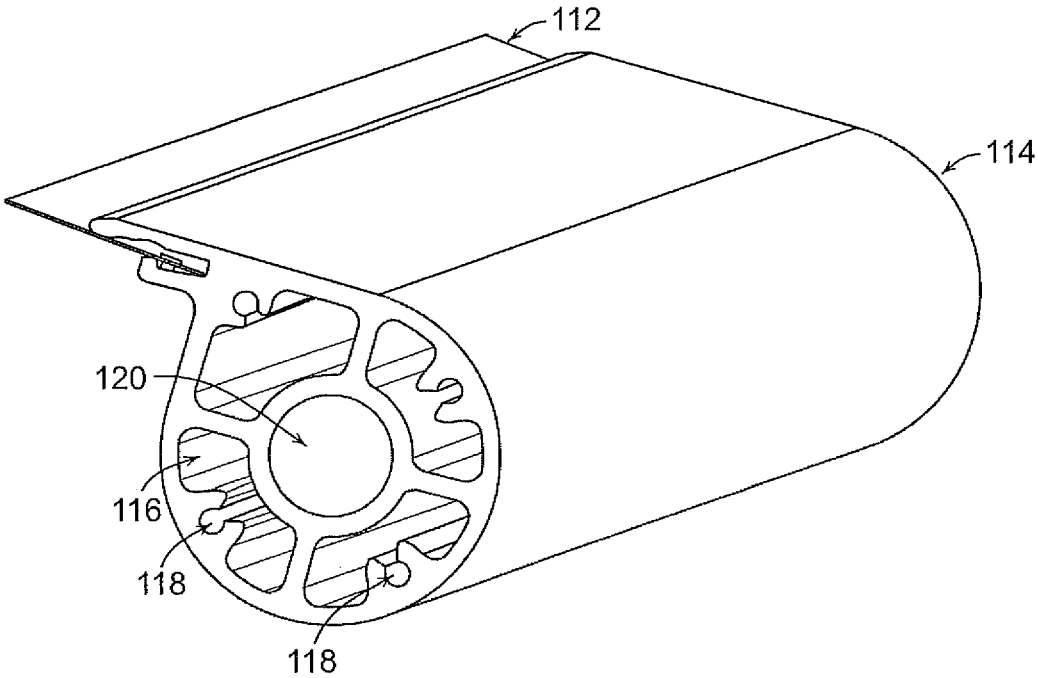
FIG. 7 is an illustrative diagrammatic top perspective view of the doctor and blade assembly of FIGS. 5 and 6.

FIG. 7 shows the doctor blade holder core 114 and blade 112 in perspective view illustrating the hollow cross machine chambers 116, integrated fastening structures 118 and the journal bore 120. Again, each cover plate 122, 124 may be attached to the integral fastening structures 118, and a journal bearing 126 that is attached to a bearing bracket 128 may align with the journal bore 120 for receiving a journal as further shown in FIGS. 9 and 10.

Figure 9:
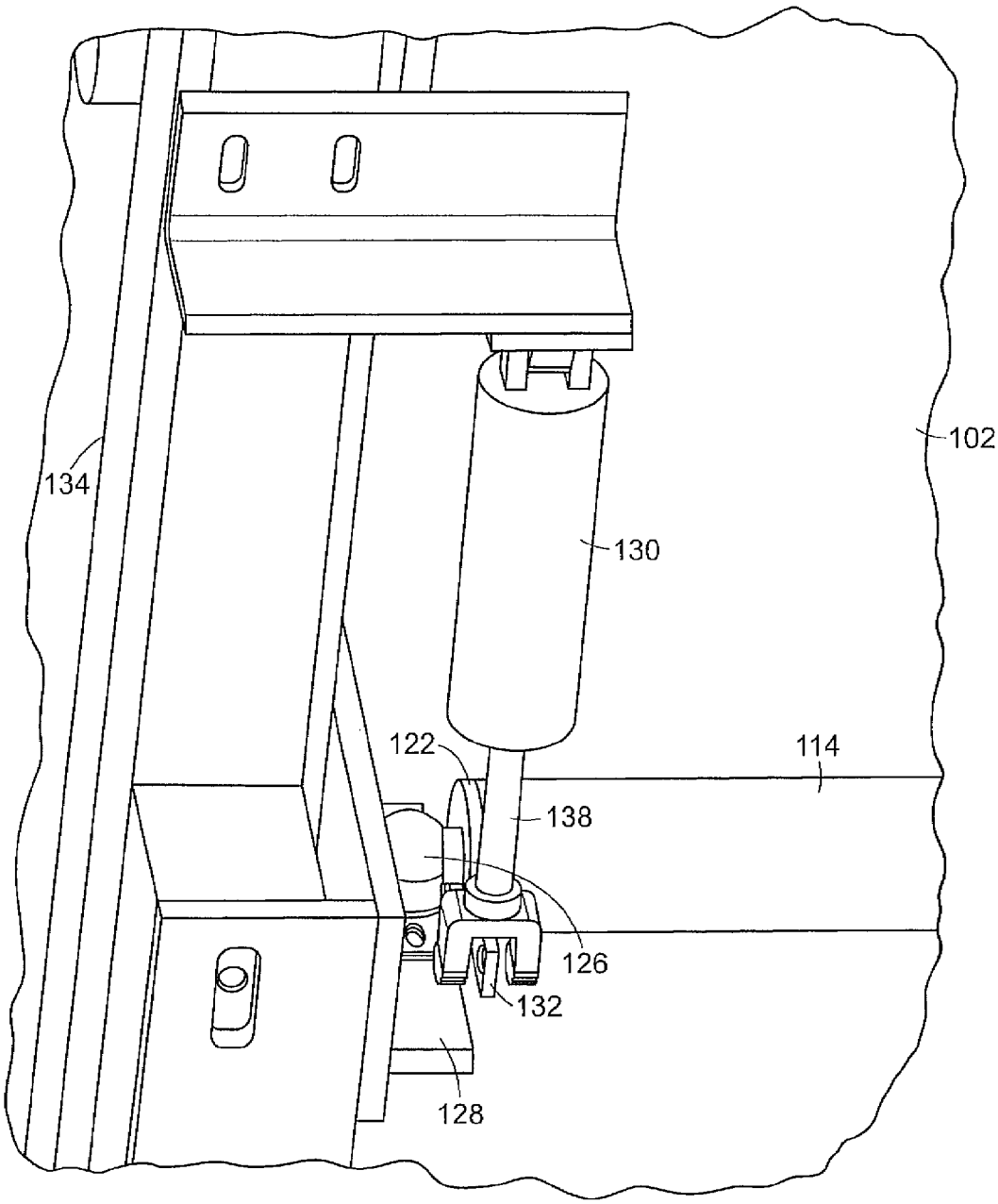
FIGS. 9 and 10 are illustrative diagrammatic enlarged views of portions of the system of FIG. 8.
Figure 10:
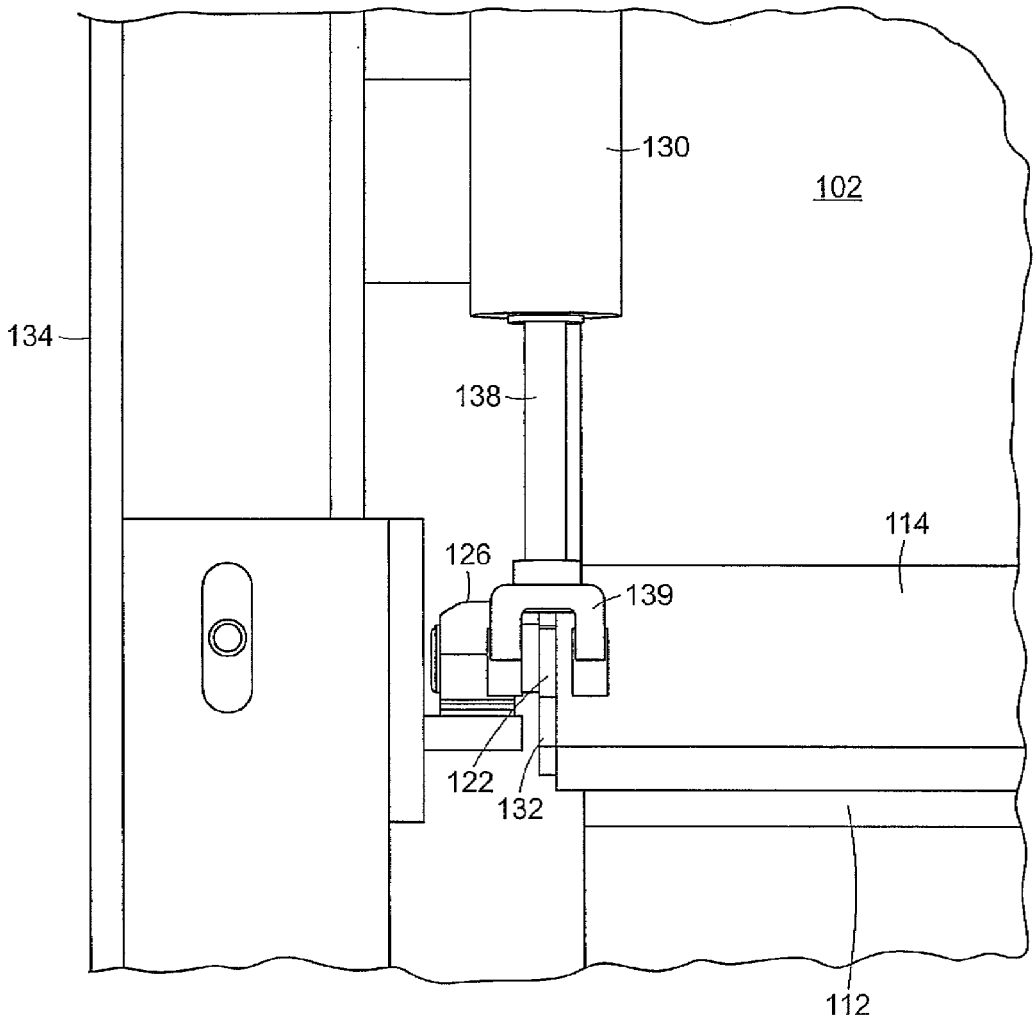

FIGS. 8-10 also show a mounting assembly by which the doctor blade holder 106 is mounted on a fixed machine frame 134 and positioned adjacent a roll 104. The doctor blade 112 is directed downward and is visible in FIG. 10. As shown, one or two air cylinders 130 (one is shown) are employed to selectively drive one or more torsion arms 130 (one is shown coupled to cover plate 122, which is also shown in FIG. 5). Each air cylinder 130 has an actuator rod 136 that is coupled via a Clevis 139 and pin (not shown) to each torsion arm 132 for causing the doctor blade holder 106 to rotate, urging the front edge of the doctor blade either toward or away from the roll surface. Applicants have found that the generally circular cross-sectional area of the doctor blade holder system (and in this embodiment, the doctor blade holder itself) facilitates in providing sufficient strength and rigidity during doctoring operations.

Figure 11:
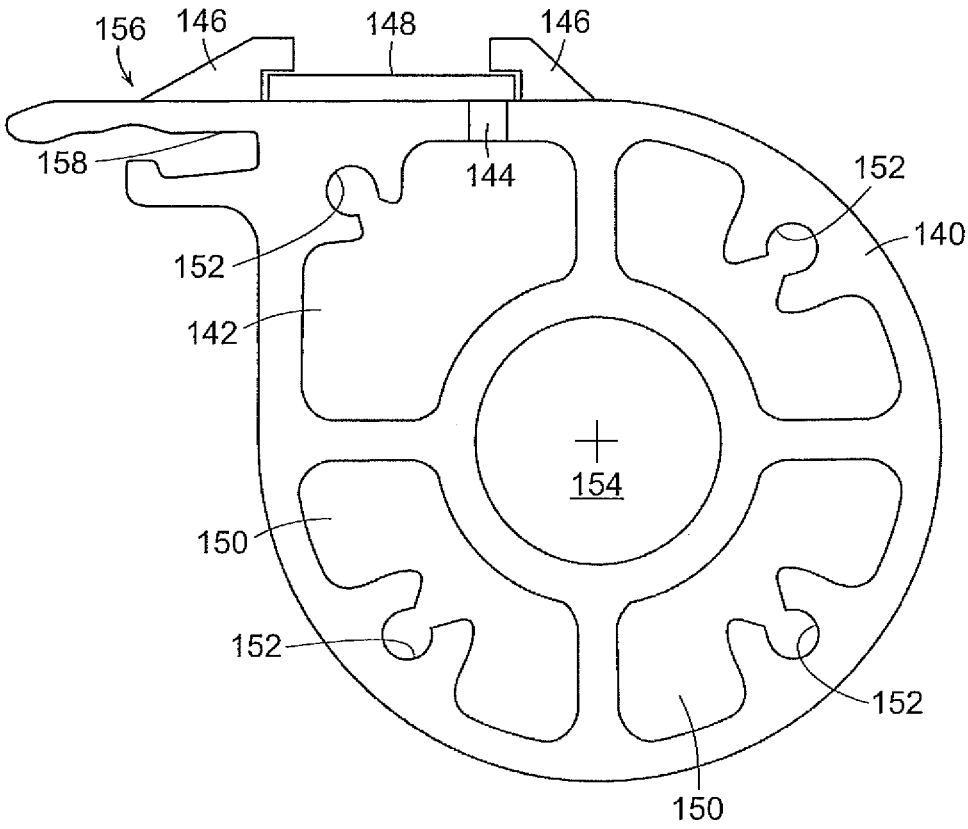
FIG. 11 shows an illustrative diagrammatic side sectional view of a doctor blade holder that includes an internal vacuum plenum and is adapted to receive a pad in accordance with another embodiment of the invention.
Figure 12:
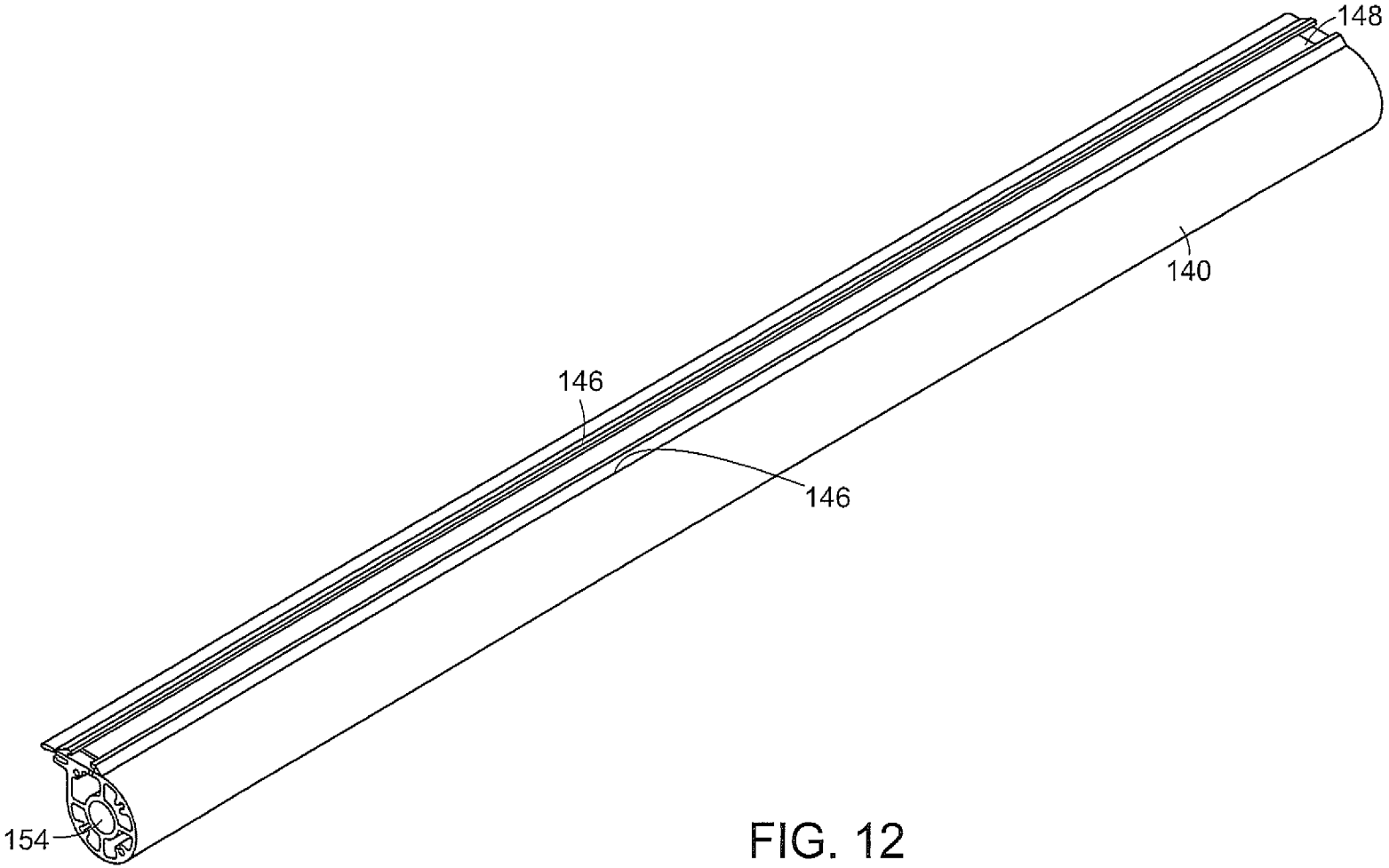
FIG. 12 shows an illustrative diagrammatic oblique view of the doctor and doctor blade holder of FIG. 11.
Figure 13:
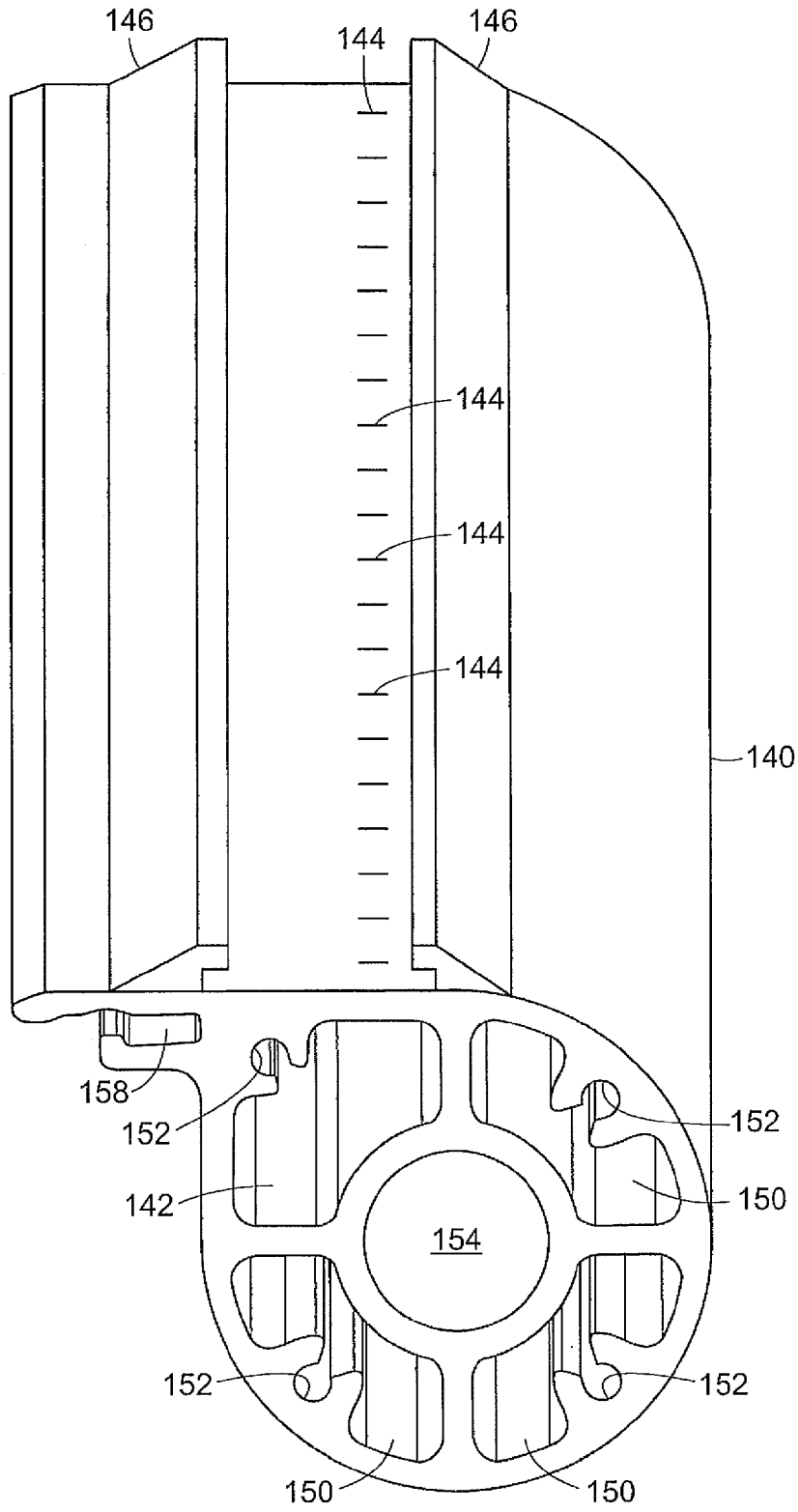
FIG. 13 shows an illustrative diagrammatic top perspective view of the doctor blade and doctor blade holder of FIGS. 11 and 12.

FIGS. 11-13 show another embodiment of the invention in which the doctor blade holder includes a doctor blade holder core 140 that is similar to the doctor blade holder 106 of FIGS. 5-10, except that a vacuum source is coupled to an internal plenum providing a cross-machine vacuum chamber 142, and a series of vacuum ports 144 (also shown in FIG. 13) that are provided in a wall of the doctor blade holder core 140. A vacuum pad retaining structure 146 is also provided for retaining a pad 148 adjacent the ports 144. During use, the vacuum draws into the pad 148, debris that becomes detached from the doctoring surface during doctoring operations. The pad 148 may then periodically be replaced. The remaining components of such as system are as described above with reference to FIGS. 5-10. For example, the doctor blade holder core 140 also includes cross-machine direction chambers 150, component fastening structures 152 and a journal bore 154 that provide functionality as discussed above with reference to the embodiment of FIGS. 5-10, as well as an integrally formed doctor blade retention region 156 that defines a slot 158 for receiving a doctor blade.

Figure 14:
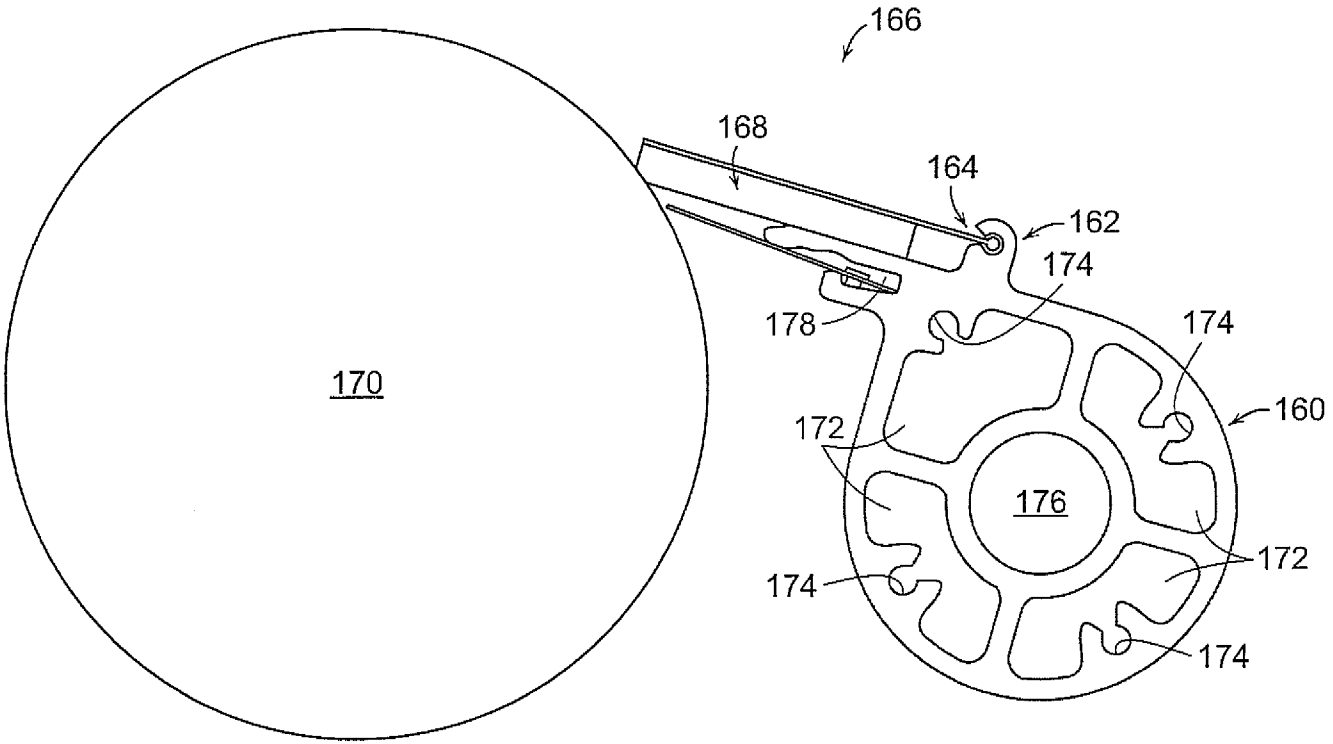
FIG. 14 shows illustrative diagrammatic side view of a doctoring system in accordance with a further embodiment of the invention having an integrated mounting means to receive a replaceable debris collection device.

FIG. 14 illustrates a further embodiment of the invention wherein the doctor blade holder core 160 has an integrally formed (female) pivotal mounting structure 162 that extends along the cross-machine direction. The mounting structure 162 receives the extended (male) pivotal mounting structure 164 of a cleaning assembly 166. In a preferred embodiment the cleaning assembly contains a pad 158 that is designed to collect debris detached from the doctored surface of the roll 170. The remaining components of such as system are as described above with reference to FIGS. 5-10. For example, the doctor blade holder core 160 also includes cross-machine direction chambers 172, component fastening structures 174 and a journal bore 176 that provide functionality as discussed above with reference to the embodiment of FIGS. 5-10 as well as an integrally formed doctor blade retention region that defines a slot 178 for receiving a doctor blade.

Figure 15:
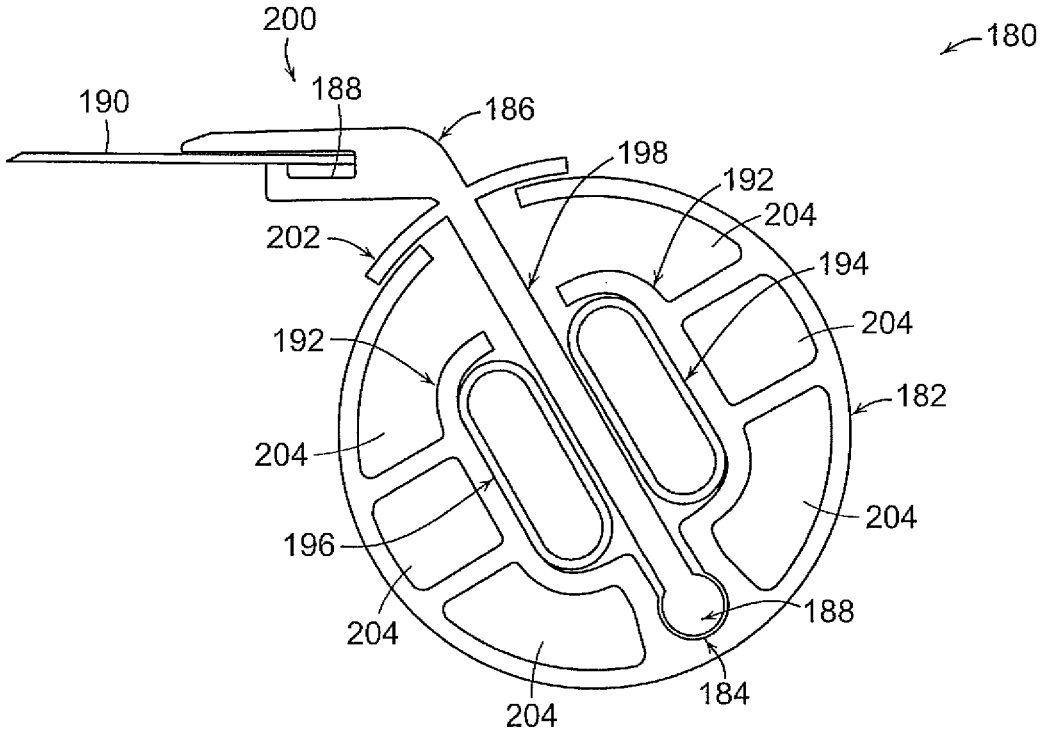
FIG. 15 is shows an illustrative diagrammatic side sectional view of a doctor blade holder in accordance with a further embodiment of the present invention wherein the doctor is rotated relative to a fixed structure via internal pressurized tubes in order to load the doctor blade tip to a surface, and to retract the doctor blade away from the surface.

FIG. 15 shows a cross-sectional view of a doctor blade holder 180 of a doctor blade holder system in accordance with a further embodiment of the invention wherein the doctor blade holder 180 includes two primary components, a first of which (a doctor blade holder core) 182 is a doctoring core structure that is fixed in place and contains an internal female pivoting structure 184 that extends in the cross-machine direction. The second primary component 186 is the doctor blade holder and includes a male pivoting structure 188 that is received within the pivoting structure 184 of the first component 182. The second primary component 186 also includes an integrally formed doctor blade retaining region 200 that defines a slot 188 for receiving a doctor blade 190 that also extends in the cross-machine direction.

The structure 182 further contains integral cross machine structures 192 that position a blade load tube 194 and blade unload tube 196 between the structures 192 and pressure arm 198 of the blade holder component 186. The doctor blade 190 is brought to bear against an adjacent surface by rotating the doctor blade retaining region 200 of the doctor blade holder component 186 counterclockwise (as shown) by pressurizing the blade load tube 194 using a pressurized fluid, preferably air, while venting fluid present in the blade unload tube 196. Similarly, the doctor blade 190 is retracted from an adjacent surface by rotating the blade holder retaining region 200 clockwise by pressurizing the blade unload tube 196 while venting the blade load tube 194. A dust shield 202 that is preferably integrally formed with the doctor blade holder component 186 covers the opening in the doctor blade holder core component 182. Applicants have found that the generally circular cross-sectional area of the doctor blade holder system (and in this embodiment, the fixed structure 182) facilitates in providing sufficient strength and rigidity during doctoring operations. The doctor blade holder core component 182 also includes cross-machine direction chambers 204, and in certain embodiments, component fastening structures (e.g., 118, 152, 174) may be included that provide functionality as discussed above with reference to the embodiments of FIGS. 5-14.

Figure 16:
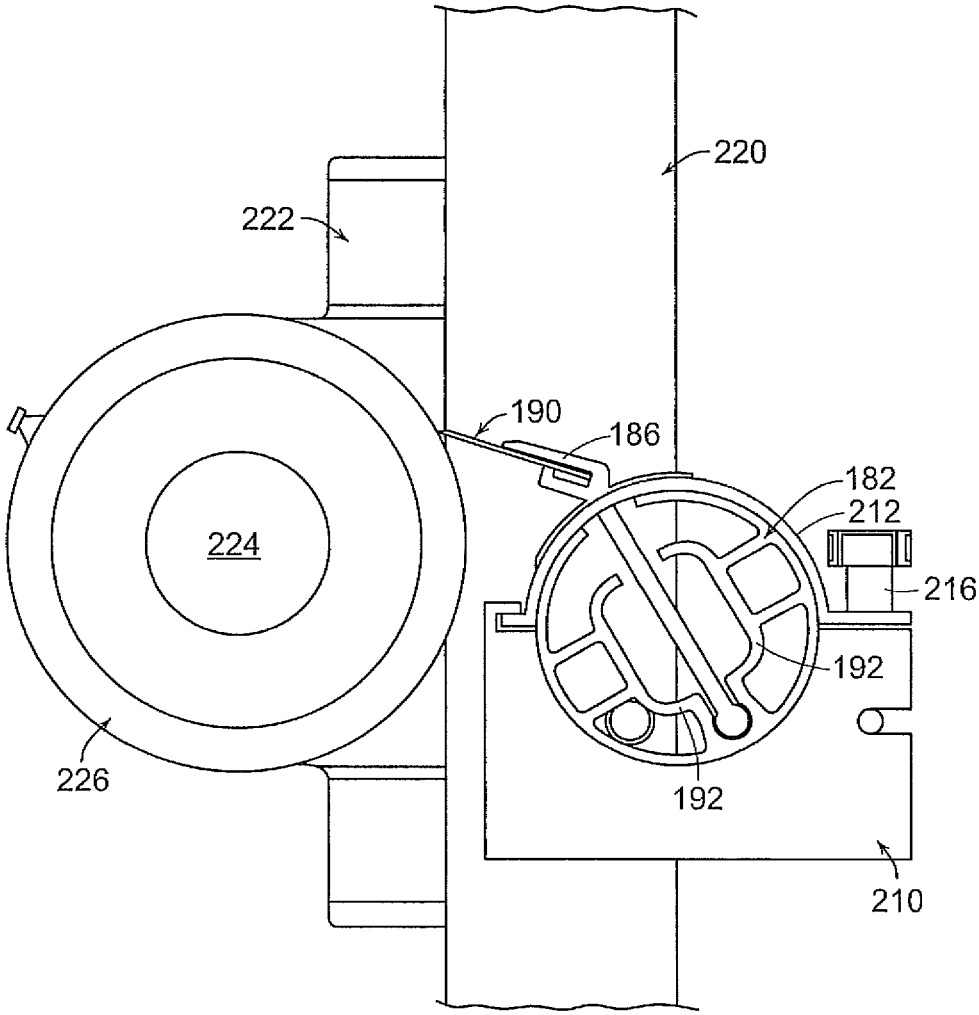
FIG. 16 shows an illustrative diagrammatic partial side view of the doctor blade holder of FIG. 15 mounted in a doctoring assembly.
Figure 17:
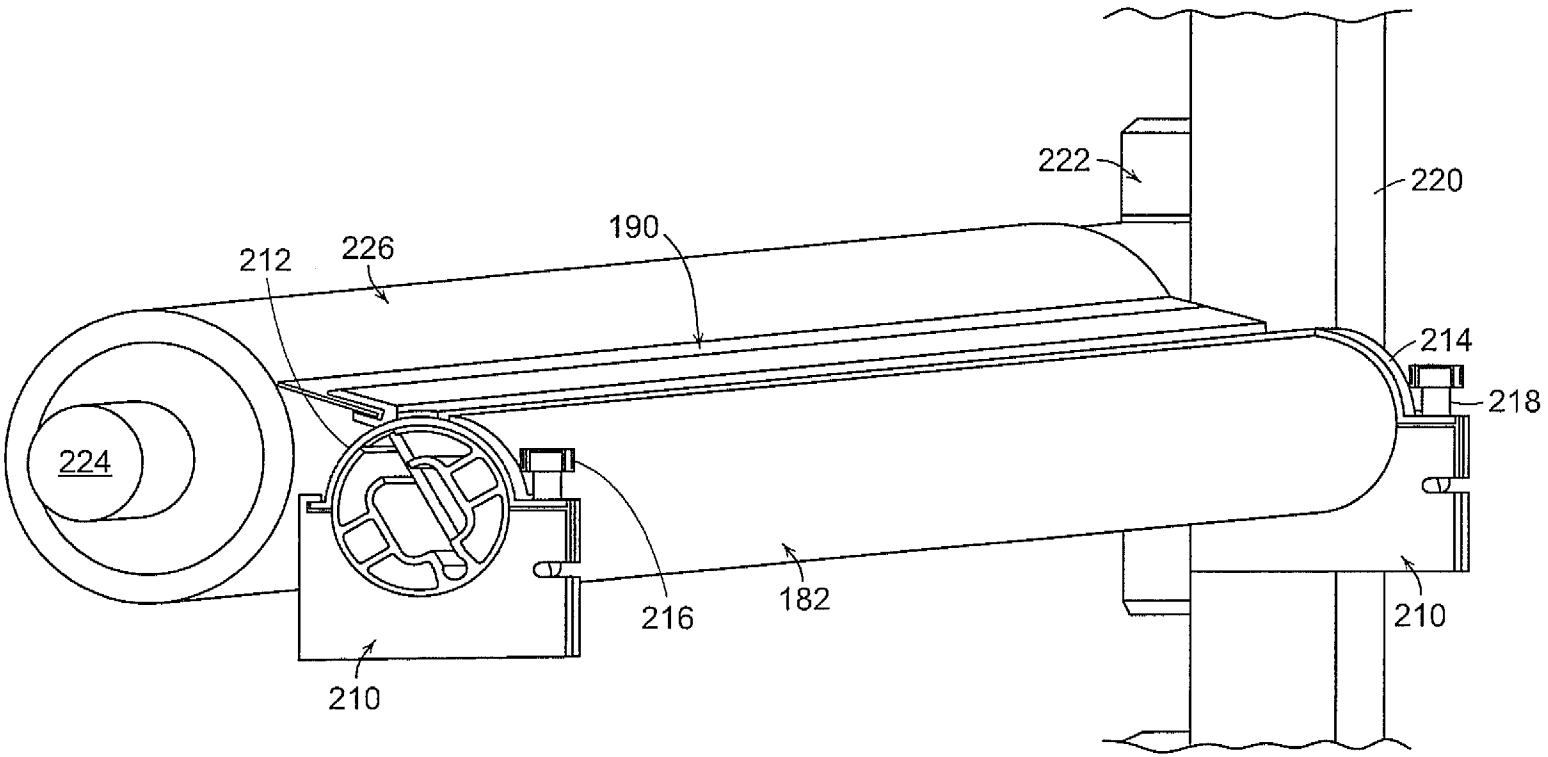
FIG. 17 shows an illustrative diagrammatic partial side perspective view of the system of FIG. 16.
Figure 18:
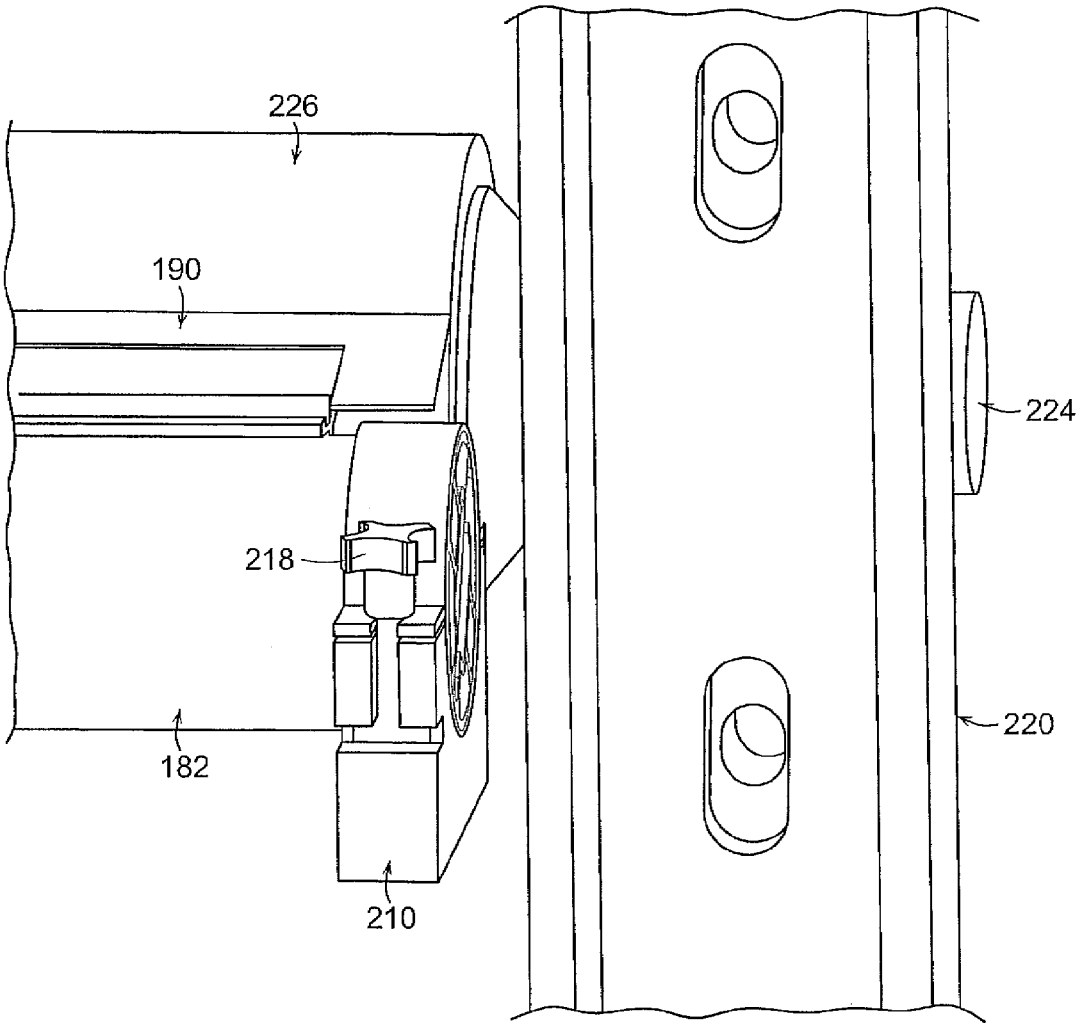
FIG. 18 shows an illustrative diagrammatic enlarged view of a portion of the mounting structure of the system of FIGS. 16 and 17.

As further shown in FIGS. 16-18, the fixed doctor blade holder core component 182 of the doctor bade holder system of FIG. 15 may be clamped within doctor bearings 210 by clamp arms 212, 214 and threaded fasteners 216, 218 at each end. The doctor bearings 210 are secured to a frame 220 as also shown at each end. Roll bearings 222 are adapted to receive roll journal ends 224 of a roll 226 to be doctored.

Figure 19:
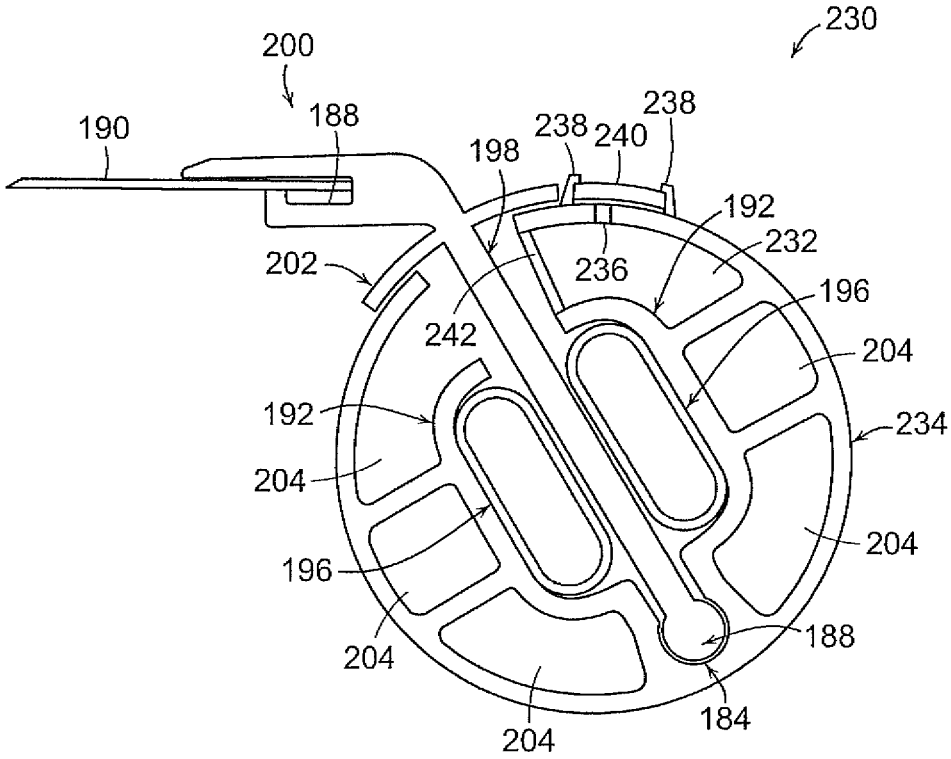
FIG. 19 shows an illustrative diagrammatic side sectional view of a doctor blade holder that includes an internal vacuum plenum and is adapted to receive a pad in accordance with a further embodiment of the invention.

FIG. 19 shows a further embodiment of the invention in which the doctor blade holder system 230 is similar to the doctor blade holder system 180 of FIGS. 15-18, except that a vacuum source is coupled to an internal plenum 232 defined within the fixed doctor blade holder core component 234 providing a vacuum chamber, and a series of vacuum ports 236 (similar to those shown in FIG. 13) are provided in a wall of the doctor blade holder core component 234. Vacuum pad retaining structures 238 are also provided for retaining a pad 240 adjacent the ports 236. During use, the vacuum draws debris into the pad 240 that becomes detached from the doctoring surface during doctoring operations. The pad 240 may then periodically be replaced The remaining components of such as system are as described above with reference to FIGS. 15-18 except that an additional wall 242 is provided to define the internal plenum.

Those skilled in the art will appreciate that numerous modifications and variations may be made to the above disclosed embodiments without departing from the spirit and scope of the invention.

What is claimed is:

1. A doctor blade holder system comprising:

a doctor blade holder that includes a doctor blade receiving region for receiving a doctor blade, and actuation means for causing the doctor blade receiving region to be selectively moved toward or away from a roll surface by rotating the doctor blade holder about a first axis, wherein the doctor blade holder system includes a doctor blade holder core that is generally circular shaped in cross-sectional area, and cross-machine structures within the doctor blade holder core, said cross-machine structures including an internal pivoting structure against which the doctor blade holder is adapted to pivot about the first axis responsive to the actuation means and wherein said doctor blade holder extends through an opening in the doctor blade holder core at an opening location of the doctor blade holder core, and wherein said internal pivoting structure is located at a pivot location that is generally opposite the opening location with respect to the generally circular shape of the doctor blade holder core.

2. The doctor bade holder system as claimed in claim 1, wherein said doctor blade holder core includes an internal plenum that is coupled to a vacuum source.

3. The doctor blade holder system as claimed in claim 2, wherein said doctor blade holder further includes a pad adjacent at least one opening that communicates with the internal plenum.

4. The doctor blade holder system as claimed in claim 1, wherein said actuation means includes loading and unloading tubes within the doctor blade holder for alternating urging the doctor blade toward or away from the roll.

5. The doctor blade holder system as claimed in claim 1, wherein said internal pivoting structure is a female pivoting structure.

6. The doctor blade system as claimed in claim 5, wherein said doctor blade holder core and said cross-machine structures define cross-machine chambers.

7. The doctor blade holder system as claimed in claim 1, wherein said cross-machine structures are integrally formed with the doctor blade holder core.

8. The doctor blade holder system as claimed in claim 1, wherein said doctor blade holder core is secured to a frame by clamps at each end of the doctor blade holder system.

9. The doctor blade holder system as claimed in claim 1, wherein said doctor blade holder includes a dust shield that extends around at least a portion of the doctor blade holder core and covers the opening location of the doctor blade holder core.

10. A doctor blade holder system comprising:

a doctor blade holder that includes a doctor blade receiving region for receiving a doctor blade, actuation means for causing the doctor blade receiving region to be selectively moved toward or away from a roll surface by rotating the doctor blade holder about a first axis that is defined by a fixed pivoting structure within the doctor blade holder, a doctor blade holder core that includes an outer wall having a cross-sectional shape that encloses the actuation means leaving an opening location through which the doctor blade holder extends, and a dust shield that extends around at least a portion of the doctor blade holder core and covers the opening location of the doctor blade holder core.

11. The doctor blade holder system as claimed in claim 10, wherein said doctor blade holder core is generally circular in cross-sectional area.

12. The doctor bade holder system as claimed in claim 10, wherein said doctor blade holder includes an internal plenum that is coupled to a vacuum source.

13. The doctor blade holder system as claimed in claim 12, wherein said doctor blade holder further includes a pad adjacent at least one opening that communicates with the internal plenum.

14. The doctor blade holder system as claimed in claim 10, wherein said actuation means includes loading and unloading cylinders for alternating urging the doctor blade toward or away from the roll.

15. The doctor blade holder system as claimed in claim 10, wherein said dust shield pivots with the doctor blade holder about the first axis.

16. A doctor blade holder system comprising:

a doctor blade holder that includes a doctor blade receiving region for receiving a doctor blade;

a fixed structure that pivotally receives a portion of the doctor blade holder at a distal end of the doctor blade holder that is distal to the doctor blade receiving region, said fixed structure being provided within a doctor blade holder core; and actuation means for causing the doctor blade receiving region to be selectively moved toward or away from a roll surface by pivoting the distal end of the doctor blade holder about the fixed structure within the doctor blade holder core;

wherein the doctor blade holder core surrounds and encloses the actuation means with the only opening in the doctor blade holder core being an opening location in the doctor blade holder core through which the doctor blade holder extends; and wherein said doctor blade holder system further includes a dust shield that extends around at least a portion of the doctor blade holder core and covers the opening location of the doctor blade holder core, and wherein said dust shield moves with the doctor blade holder.

17. The doctor blade holder system as claimed in claim 16, wherein said doctor blade holder core is generally circular in cross-sectional area.

18. The doctor bade holder system as claimed in claim 16, wherein said doctor blade holder core includes an internal plenum that is coupled to a vacuum source.

19. The doctor blade holder system as claimed in claim 16, wherein said fixed structure is integrally formed with the doctor blade holder core.

20. The doctor blade holder system as claimed in claim 16, wherein said actuation means includes loading and unloading tubes within the doctor blade holder core for alternating urging the doctor blade toward or away from the roll surface.

21. The doctor blade holder system as claimed in claim 16, wherein said fixed structure includes an integrally formed internal female pivoting structure.

22. The doctor blade holder system as claimed in claim 16, wherein said dust shield is integrally formed with the doctor blade holder.

* * * * *

UNITED STATES PATENT AND TRADEMARK OFFICE

CERTIFICATE OF CORRECTION

PATENT NO. : 8,898,851 B2
APPLICATION NO. : 13/315899
DATED : December 2, 2014
INVENTOR(S) : Leeman et al.

It is certified that error appears in the above-identified patent and that said Letters Patent is hereby corrected as shown below:

In the Specification

In column 6, line 67 should read as follows:

"then periodically be replaced. The remaining components of"

Signed and Sealed this
Seventh Day of April, 2015

Michelle K. Lee

Michelle K. Lee
*Director of the United States Patent and Trademark Office*